US010341763B2

(12) United States Patent
Li et al.

(10) Patent No.: US 10,341,763 B2
(45) Date of Patent: Jul. 2, 2019

(54) PASSIVE RADIATOR ASSEMBLY

(71) Applicant: HARMAN INTERNATIONAL INDUSTRIES, INCORPORATED, Stamford, CT (US)

(72) Inventors: Shengbo Li, Guangdong (CN); An Duc Nguyen, West Hills, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 15/563,860

(22) PCT Filed: Apr. 2, 2015

(86) PCT No.: PCT/US2015/024072
§ 371 (c)(1),
(2) Date: Oct. 2, 2017

(87) PCT Pub. No.: WO2016/160020
PCT Pub. Date: Oct. 6, 2016

(65) Prior Publication Data

US 2018/0077486 A1 Mar. 15, 2018

(51) Int. Cl.
*H04R 1/28* (2006.01)

(52) U.S. Cl.
CPC ..... *H04R 1/2834* (2013.01)

(58) Field of Classification Search
CPC .... H04R 1/2834; H04R 1/227; H04R 1/2873; H04R 1/2826; H04R 1/2842; H04R 1/345
USPC ..... 381/186
See application file for complete search history.

(56) References Cited

U.S. PATENT DOCUMENTS

| | | | | |
|---|---|---|---|---|
| 4,512,434 | A * | 4/1985 | Yoo | H04R 1/2819 181/146 |
| 5,850,460 | A | 12/1998 | Tanaka et al. | |
| 7,133,533 | B2 | 11/2006 | Chick et al. | |
| 2003/0228027 | A1 | 12/2003 | Czerwinski | |
| 2005/0018868 | A1* | 1/2005 | Chick | H04R 1/2834 381/349 |
| 2007/0092096 | A1 | 4/2007 | Litovsky | |
| 2012/0033826 | A1* | 2/2012 | Kakumoto | H04R 1/28 381/86 |
| 2014/0193005 | A1 | 7/2014 | Riggs | |

FOREIGN PATENT DOCUMENTS

| | | | | |
|---|---|---|---|---|
| WO | 2013166648 | A1 | 11/2013 | |
| WO | WO 2013166648 | A1 * | 11/2013 | H04R 1/28 |

* cited by examiner

*Primary Examiner* — Curtis A Kuntz
*Assistant Examiner* — Julie X Dang
(74) *Attorney, Agent, or Firm* — Brooks Kushman P.C.

(57) ABSTRACT

A passive radiator assembly for a loudspeaker system comprising: a pair of passive radiators including a first and a second passive radiator; a frame having a first, a second and a third opening wherein the first and second opening are located on parallel sides of the frame, respectively, wherein the first and the second passive radiator are mounted into the first and second opening of the parallel sides of the frame, respectively, so as to oppose each other at a predetermined distance.

18 Claims, 5 Drawing Sheets

PASSIVE RADIATOR ASSEMBLY

CROSS-REFERENCE TO RELATED APPLICATION

This application is the U.S. national phase of PCT Application No. PCT/US2015/024072 filed on Apr. 2, 2015, the disclosure of which is incorporated in its entirety by reference herein.

TECHNICAL FIELD

The present invention relates to a new design of a passive radiator assembly, specifically for speaker applications, and a loudspeaker system using the passive radiator assembly.

BACKGROUND

Conventional loudspeaker boxes are well known for many audio applications, both for applications at home, in particular the so called High Fidelity, HiFi, and larger systems for public or professional use.

A loudspeaker box refers to a system or unit comprising one or more single loudspeakers, called transducers or drivers, and a specifically engineered cabinet. Commonly, the entire system is loosely called "loudspeaker", although that term should be used only for the single loudspeakers/drivers. The most commonly used type of loudspeaker is the dynamic speaker which operates such that an alternating current electrical audio signal input is applied through a voice coil, i.e. a coil of wire suspended in a circular gap between the poles of a permanent magnet, the coil is forced to move rapidly back and forth due to Faraday's law of induction. This movement of the coil causes a diaphragm attached to the coil to move back and forth, thereby pushing on the air to create sound waves. The loudspeaker box usually also comprises cross-over circuits, amplifiers, cables, connecting sockets and other electronic hardware. The loudspeaker box may also comprise to some extent material for acoustic absorption, such as soft, pliable, porous or foam like materials.

The loudspeaker enclosure may be a specifically engineered cabinet in which the drivers and associated electronic hardware are mounted. The design of such enclosures varies from simple, rectangular box-shaped cabinets to pyramidal, complex cabinet shapes.

A loudspeaker box may include several active drivers. Such a system may be called a multi-driver speaker system. Typically, a crossover may be used in multi-driver speaker systems for separating the input signal into different frequency ranges suited for each driver. The respective drivers would then receive power only in their usable frequency range. In particular for lower frequencies, the speaker enclosure may also include a passive radiator, also known as a "drone cone". The passive radiator may typically be similar to an active driver, but without a voice coil and magnet assembly, and not being attached to a voice coil or any electrical circuit. It simple represents a suspended cone. In fact, even another driver of the same type may be used for that purpose if it is not electromagnetically driven. When in use, the passive radiator moves in response to changing enclosure pressures as are induced by the active driver or active drivers. Passive radiator systems use the behavior of masses of air, the enclosed air in the box acting like a spring joined to a mass.

A passive radiator may typically increase the low frequency response, i.e. bass of a speaker system. It may give a speaker system the comparable performance characteristics of a much larger system.

The physical forward/backward movement of the driver affects the internal air pressure of the enclosure. When a passive radiator is mounted to the same speaker box, the internal air pressure fluctuations caused by the movement of the driving speaker causes the passive radiator to begin moving forward/backward as if it was also a driven speaker. Thus when the passive radiator moves, it creates sound frequencies just as a normal driver does.

FIG. 1 shows a side view of a typical design of a conventional loudspeaker 1 with one speaker driver 11 and one conventional passive radiator 5, both placed in the front side of the loudspeaker 1, i.e. the side normally facing a user. The passive radiator 5 may be used to augment the bass performance if the design parameters are tuned correctly. The loudspeaker 1 comprises an enclosure 3 and the speaker driver 11 is placed in the inside 17 of the loudspeaker 1, fixed behind the front side of the loud-speaker 1. The speaker driver 11 comprises a magnet 13 surrounding a voice coil which is not visible in FIG. 1. The speaker driver further includes a diaphragm 15. The conventional passive radiator 5 includes a center panel 9 and a suspension, also called spider 7 surrounding the center panel 9.

FIG. 2 shows schematically a front view of the passive radiator 5 of FIG. 1. The suspension 7 provides the compliance and the center panel 9 provides the acoustic mass for the passive radiator 5 to work properly within the loudspeaker 1 of FIG. 1.

The passive radiator 5 of FIGS. 1 and 2 operates in such a way that when the speaker driver 11 produces sound, the passive radiator 5 is activated and vibrates simultaneously thus generating useful sound to enhance the performance, specifically the bass performance due to the increased amount of low frequency.

A loudspeaker such as the loudspeaker 1 in FIGS. 1 and 2 with one single passive radiator 5 has the problem of introducing a detrimental "walking" problem. When the loudspeaker plays music and thus vibrates the speaker internal air pressure changes accordingly and applies an acting force to the passive radiator. Typically, the momentum is high because the center panel is heavy.

FIG. 3 shows the same elements with the same reference signs as in FIG. 1. The driver 11 produces sound which also causes vibrations, i.e. pressure fluctuations in the inside 17 of the loudspeaker 1. The pressure fluctuations are denoted with p and corresponding arrows acting on the passive radiator 5 from the inside 17 of the loudspeaker 1. As is depicted in FIG. 3, this may cause a force F1 acting on the loudspeaker 1. The typical abrupt changes of the pressure vibrations will result in abrupt changes of the force F1 and will often cause the loudspeaker 1 to move notably. This is called the "walking" problem or walking of the loudspeaker. The loudspeaker movement thus may cause unwanted noise and ultimately even safety issues in real life when the loudspeaker is used. Both of these issues may be very annoying with regard to the listening experience for the user and may be even dangerous.

One solution to resolve the walking issue is to add a second passive radiator on the opposite side of the first passive radiator on the loudspeaker so as to counteract its force. This is schematically shown in FIG. 4. FIG. 4 shows the same elements as in FIGS. 1-3. Passive radiator 5.1 of FIG. 4 may be the same as passive radiator 5 in FIGS. 1-3. It comprises central part 9.1 and suspension 7.1 which may be the same as central part 9 and suspension 7 of FIGS. 1-3. In addition, a second passive radiator 5.2 comprising suspension 9.2 and central part 9.2. The force F1 generated by the first passive radiator 5.1 is substantially equal to the force F2 generated by the second passive radiator 5.2. However this solution implies the two passive radiators being mounted on the external surfaces of the speaker box which may not be favored in some speaker designs, in particular when the designer does not want the passive radiators to be visible, or in case the speaker designer wants to achieve a more compact speaker design.

In view of the above-mentioned problems it is an object of the present invention to provide an alternative solution to the walking problem.

SUMMARY

The above-mentioned problem is solved by a passive radiator assembly for a loud-speaker system according to claim 1.

The invention provides a passive radiator assembly for a loudspeaker system comprising: a pair of passive radiators including a first and a second passive radiator; a frame having a first, a second and a third opening wherein the first and second opening are located on parallel sides of the frame, respectively, wherein the first and the second passive radiator are mounted into the first and second opening of the parallel sides of the frame, respectively, so as to oppose each other at a predetermined distance.

According to this aspect the frame is a structure with three openings: two openings are configured to accommodate the two pieces, i.e. the first and second of passive radiators, whereas a third opening is configured to let the sound and air flow in and out. The two passive radiators are accommodated on opposite sides of the structure, i.e. the frame. The two passive radiators may be conventional passive radiators. Thereby a separate assembly can be formed. Mounting the two passive radiators on opposite and parallel sides of the frame has the effect to counteract vibration of the frame. When the frame is combined with a loudspeaker system, for example, a speaker enclosure of such a loudspeaker system, the reduced vibration of the frame has the effect of substantially reducing the walking problem of the loudspeaker system.

In the passive radiator assembly the first passive radiator may have a first maximum excitation amplitude and the second passive radiator may have a second maximum excitation amplitude, wherein the predetermined distance between the mounted first and second passive radiator may be larger than the sum of the first and the second maximum excitation amplitudes.

The first maximum excitation amplitude and the second maximum excitation amplitude, respectively, should be understood as the maximum elongation or vibration of a central part, also called acoustic mass, of the passive radiator as may be induced by sound from active drivers. It is clear that these maximum amplitudes will typically only be reached when large acoustic bass power is produced by the active drivers. A sufficiently large distance between the first and the second passive radiator may avoid the two passive radiators touching each other, thereby avoiding generating an unwanted rattling noise due to the touching of the passive radiators when the driver operates.

In the passive radiator assembly for a loudspeaker system the opening area of the third opening may be equal to or larger than ⅛ of the sum of the total area of each of the passive radiators.

Observing the size of the opening area should being no smaller than ⅛ of the total area, i.e. the area of both passive radiators together, have the effect of reducing or avoiding air turbulence noise as well as avoiding reduced bass sound.

In the passive radiator assembly for a loudspeaker system the first and the second passive radiator may be similar.

Typically, both the first and the second passive radiator may be substantially the same such that both may perform similarly when sound is played in the loudspeaker system. Due to the specific positioning in the frame the similarity of the passive radiators may provide the effect that any unwanted effects induced by one of the passive radiators may be largely cancelled by the second passive radiator which is similar to the first one.

In the passive radiator assembly for a loudspeaker system the frame may have a fourth side opposite to the third opening; wherein the fourth side together with the first and second passive radiator mounted into the first and second opening of the parallel sides may form three sides of an enclosure.

In the passive radiator assembly for a loudspeaker system the three sides of the enclosure may be sealed.

In the passive radiator assembly for a loudspeaker system the frame may be made of at least one of metal, ceramics, plastics, or wood.

In the passive radiator assembly for a loudspeaker system according each of the first and second passive radiator may comprise a spider and a center panel.

In the passive radiator assembly for a loudspeaker system the spider may include soft and flexible material such as rubber and the center panel may include hard material such as metal.

The invention further provides a loudspeaker system comprising: a passive radiator assembly as described above; a speaker box; a speaker driver; the speaker box comprising a slot into which the passive radiator assembly is mounted.

In the loudspeaker system as described above the speaker driver may be mounted into a front side of the speaker box, the passive radiator assembly may be mounted into the slot such that the third opening of the passive radiator assembly is located at the front side of the speaker box.

In the loudspeaker system as described above the opening of the passive radiator assembly may be exposed to external air when mounted into the slot.

The loudspeaker system comprises a speaker driver and a closed speaker box, except for one opening to mount the Passive Radiator assembly. The slot of the assembly may be exposed to external air. The speaker drivers, speaker enclosure and the passive radiator assembly may form a sealed speaker box. When the speaker driver starts to play sound, the two passive radiators will operate accordingly and produce sound though the slot. The bass performance may be improved due to dual passive radiator design. Furthermore, the loudspeaker system is easier to assemble due to the mounting of the integral passive radiator assembly. The loudspeaker system enables a new speaker structural design where the passive radiator components are not exposed to the users. It also enables a more compact speaker design since the new passive radiator assembly, for example, the new structure may be inserted into the speaker enclosure and thus be accommodated inside the speaker enclosure in a different way from a conventionally use passive radiator assembly.

In the loudspeaker system as described above the speaker box, the speaker driver, and the passive radiator assembly mounted into the slot may form a sealed enclosure.

In the loudspeaker system as described above the passive radiator assembly may be mounted into the slot by means of glue and/or screws.

Thereby, the passive radiator assembly may be fixed with an appropriate fixing means.

The invention also provides a method of retrofitting a loudspeaker system, the loudspeaker system comprising a speaker driver, a speaker box comprising a slot into which a passive radiator assembly is mountable, the method comprising: providing the loudspeaker system; mounting a passive radiator assembly as described above into the slot such that the opening of the passive radiator assembly is exposed to external air when mounted into the slot.

By retrofitting a loudspeaker system the bass performance of the given loudspeaker system may be improved without inducing a walking problem.

Additional features and advantages of the present invention will be described with reference to the drawings. In the description, reference is made to the accompanying Figures that are meant to illustrate preferred embodiments of the invention. It is under-stood that such embodiments do not represent the full scope of the invention.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 5:
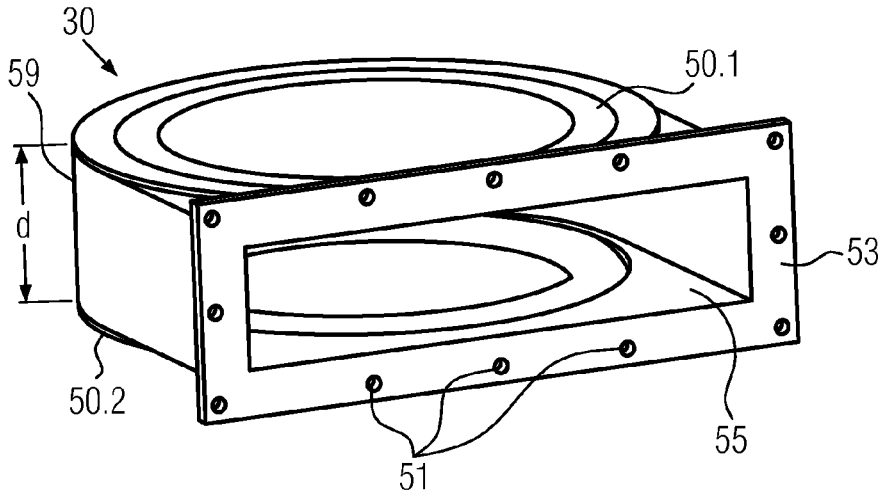
FIG. 5 shows a passive radiator assembly having a structural frame and two passive radiators accommodated therein according to the present invention.

FIG. 5 shows an example of a passive radiator assembly 30 having a structural frame 53 and two passive radiators 50.1 and 50.2, which are called a first passive radiator 50.1 and a second passive radiator 50.2. The two passive radiators 50.1 and 50.2 are accommodated in the structural frame 53.

The frame 53 may comprise one or more of materials such as metal, ceramics, plastics or wood.

Figure 6:
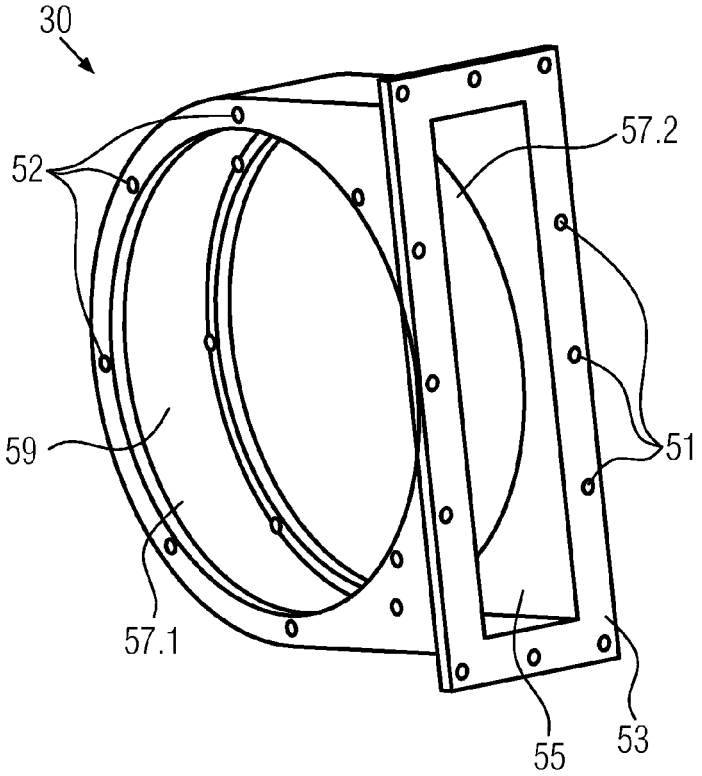
FIG. 6 shows a schematic view of the structural frame of FIG. 5.

As shown in FIG. 6, the structural frame has two openings 57.1 and 57.2 which are configured to accommodate the first passive radiator 50.1 and a second passive radiator 50.2, respectively, cf. FIG. 5. FIGS. 5 and 6 display a third opening 55 of the structural frame 53. FIGS. 5 and 6 display holes 51 and 52 located at the respective edges of the sides of the frame 53. Holes 51 and 52 may be used for screwing or riveting the frame 53 on some larger structure such as a front side of a loudspeaker system.

In FIGS. 5 and 6, the third opening 53 is configured to let the sound and air flow in and out of the passive radiator assembly. The dimension of the third opening 55 may be designed properly taking account of the following factors. The total area S55 of the opening 55 should be not smaller than ⅛ of the total area of the passive radiators 50.1 and 50.2. If the total area, i.e. the surface area of passive radiator 50.1 is denoted S1 and the respective surface area of passive radiator 50.2 is denoted S2, this may be formulated as:

$$S_{55} \geq \tfrac{1}{8}(S_1+S_2)$$

Figure 8:
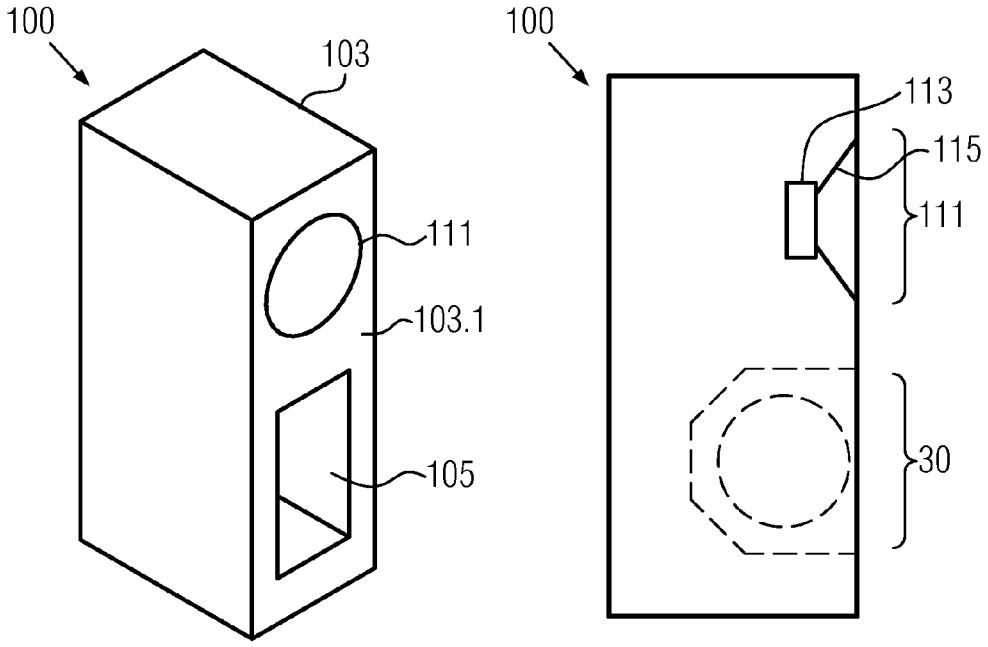
FIG. 8 shows a loudspeaker system enclosure and a side view of a loudspeaker system including the passive radiator assembly of FIGS. 5 and 6.
Figure 9:
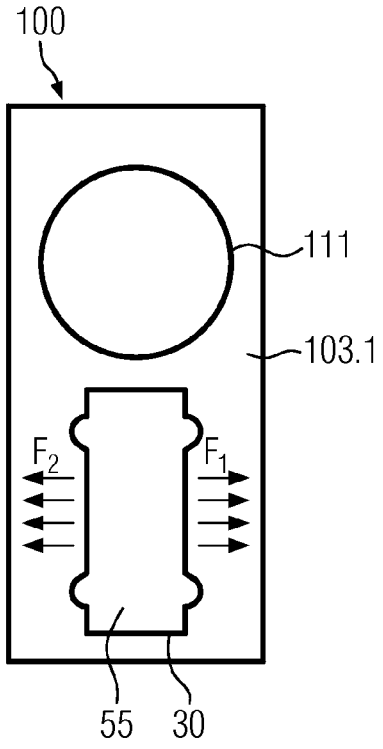
FIG. 9 shows a front view of the loudspeaker system of FIG. 8.
Figure 10:
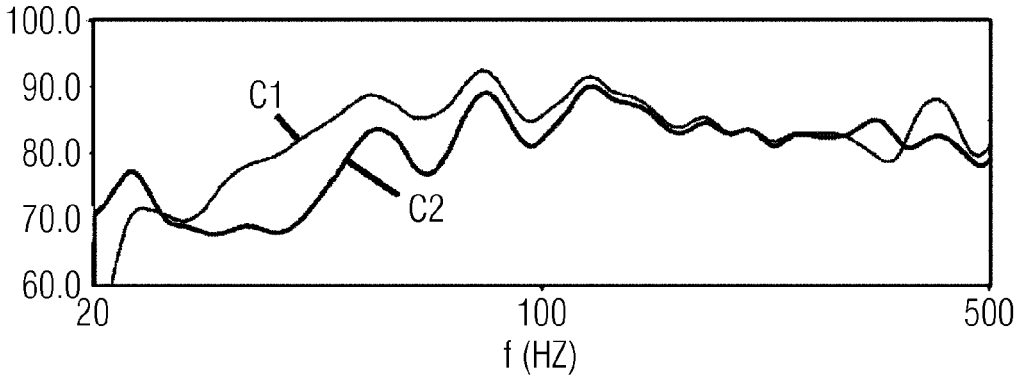
FIG. 10 shows low frequency performances of a loudspeaker system such as shown in FIGS. 8 and 9, including the passive radiator assembly, and of a loudspeaker system without a passive radiator assembly.

This may reduce or even avoid air turbulence noise and losses, i.e. degradation, of bass sound, in particular when the passive radiator assembly is mounted in a loud-speaker system, cf. FIGS. 8-10.

As shown in FIGS. 5 and 6, the passive radiator assembly 30 and thus the structural frame 53 also have a fourth side 59, which has a predetermined width, d. The fourth side typically has no opening. The fourth side 59 may have a band-like shape and may be at least in part semi-circularly shaped so as to fit to the shape of the passive radiators 50.1 and 50.2, respectively.

In the passive radiator assembly 30 in FIGS. 5 and 6, the first passive radiator 50.1 has a first maximum excitation amplitude A1 and the second passive radiator 50.2 has a second maximum excitation amplitude A2. This is further detailed in FIG. 7.

Figure 7:
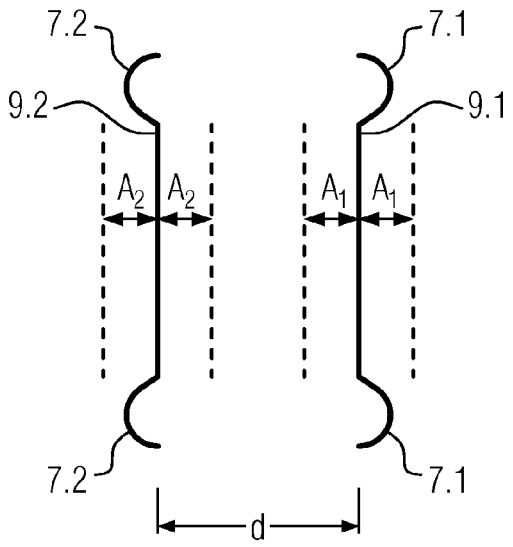
FIG. 7 show schematically the distance between two passive radiators.

In FIG. 7, the maximum excitation amplitudes are drawn not to scale but are exaggerated for explanatory purposes. It should be understood that scales of excitations typically are smaller than depicted in FIG. 7. FIG. 7 shows a schematic side view of a first and a second passive radiator. These two passive radiators may be the same as those shown in FIGS. 5 and 6. For the parts of the respective radiators the same reference signs are used as in FIGS. 5 and 6. When air pressure variations, i.e. sound impact the first and second passive radiators of FIG. 7, the center part 9.1 and 9.2 of the first and second radiators, respectively may be passively excited by said air pressure variations. The maximum excitation for the first passive radiator corresponds to the first maximum excitation amplitude A1 and for the second passive radiator corresponds to the second maximum excitation amplitude A2. This is schematically depicted by arrows in FIG. 7. The distance, d between the two passive radiators should at least be equal to or should be larger than the sum of the first and the second maximum excitation amplitudes. This may also be expressed as:

$$d \geq A_1 + A_2$$

or, if the two passive radiators 50.1 and 50.2 are similar such that A1 is equal to A2

$$d \geq 2A_1$$

For the structural frame shown in FIGS. 5 and 6, d corresponds to the width of the fourth side 59. Thus, this new design of a passive radiator assembly 30 typically features two conventional of passive radiators 50.1 and 50.2 which when integrated into the structural frame 30 form a separate passive radiator assembly 30. The proper choice of the distance d between the two passive radiators according to the formulae given above may have the effect that the distance d between the two passive radiators may be large enough to avoid the two passive radiators touching each other thus avoiding generation of a rattling noise when the loudspeaker operates, for example, when the passive radiator assembly 30 is mounted into a loudspeaker system, cf. FIGS. 8-10. Otherwise, such a noise typically may occur when loud music is played with the system, i.e. a lot of vibrational energy excites the passive radiators.

FIGS. 8 and 9 show an application of the design of a loudspeaker system 100 with a passive radiator assembly 30 according to FIGS. 5-7.

FIG. 8 shows a loudspeaker box, also called speaker enclosure, 103 having a front side 103.1. The front side usually is the side facing the user of the loudspeaker system 100.

The speaker enclosure 103 has a speaker driver 111 and a slot 105 into which the passive radiator assembly 30 as shown in FIGS. 5-7 is mountable. The second view in FIG. 8 schematically shows the passive radiator assembly 30 fit into the slot 105 of the speaker enclosure 103.

It should be understood that the invention thereby also provides a method of retrofitting a loudspeaker system 100. Such a method may comprise providing a loudspeaker system 100 having a speaker box 103, a speaker driver 111, and a slot 105 into which a passive radiator assembly 30 according to FIGS. 5-7 is mountable. Then, the passive radiator assembly 30 according to FIGS. 5-7 may be mounted into the slot 105 in such a way that the opening of the passive radiator assembly 30 is exposed to external air.

FIG. 9 shows again a front view of a front side 103.1 of a loudspeaker system 100 having the passive radiator assembly 30 mounted into the system. The loudspeaker system may be the same as depicted in FIGS. 5-8. This loudspeaker system 100 of FIG. 9 provides an example of a system comprising a speaker driver 100 and a speaker box which is closed, except for one opening to mount the passive radiator assembly 30. As the passive radiator assembly 30 is mounted into the system 100, the third opening of the passive radiator assembly 30, cf. FIGS. 5 and 6, may be exposed to external air. For the loudspeaker system 100 shown in FIG. 9, the speaker driver 111, the speaker enclosure and the passive radiator assembly 30 may form a sealed speaker box. When the speaker driver 111 starts to play sound, the two passive radiators shown in FIGS. 5-8 will operate accordingly, for example, will be excited by pressure variations inside the sealed speaker box and will produce sound though the third opening 55.

Figure 1:
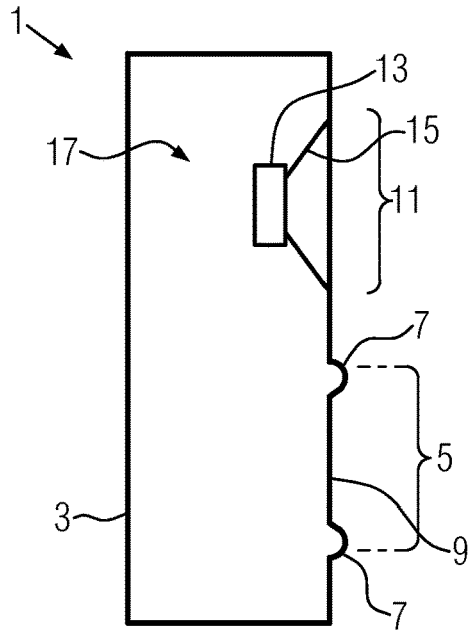
FIG. 1 shows a side view of a conventional loudspeaker with one passive radiator.
Figure 2:
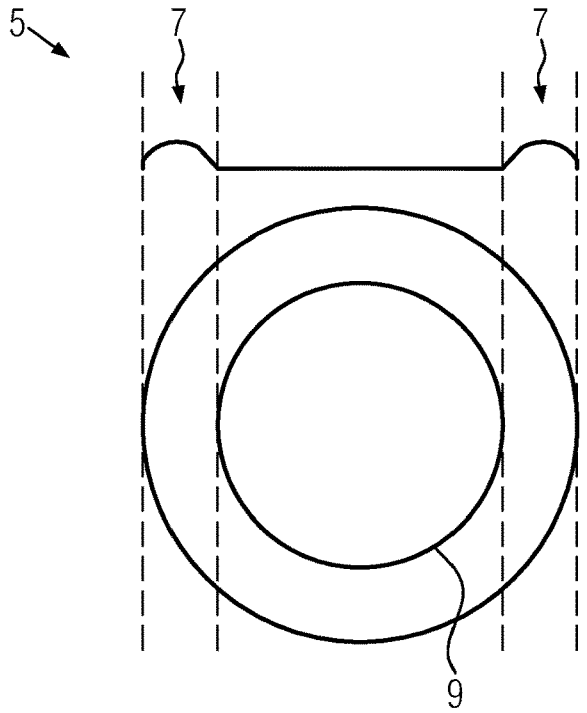
FIG. 2 shows a front view of the passive radiator of FIG. 1.
Figure 3:
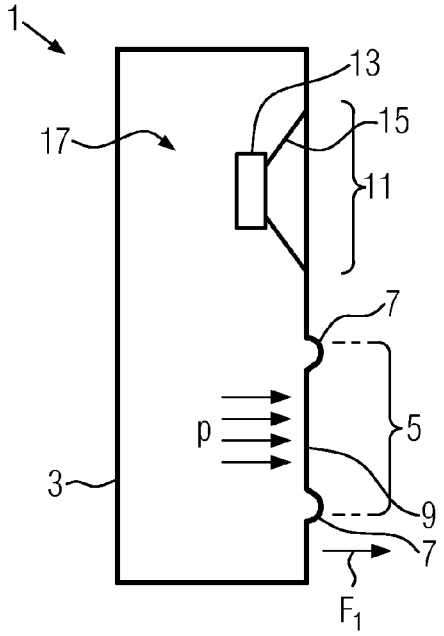
FIG. 3 shows a side view of a conventional loudspeaker as in FIG. 1 and showing the pressure and force acting on the loudspeaker.
Figure 4:
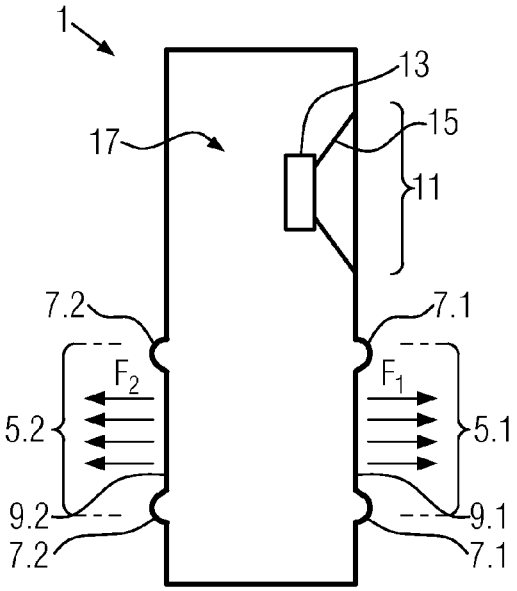
FIG. 4 shows a loudspeaker as in FIGS. 1-3 having a second passive radiator.

In a test, two loudspeaker systems were compared. For system "A", a first loudspeaker system having only one conventional single passive radiator similar to the one shown in FIG. 1 was used. For system "B", a second loudspeaker system similar to the loudspeaker system 100 of FIGS. 5-9 was used, the second one having the new passive radiator assembly 30 included. Both systems "A" and " " were tested under using the same music and the same power input. Within about five minutes speaker system "A" moved about 2.5 cm, whereas speaker system "B" moved about 0 cm, i.e. system "B" essentially did not move at all, it did not exhibit a walking problem.

FIG. 10 shows a further test and comparison of the low frequency performance of a loudspeaker system 10 having the new passive radiator assembly 30 over a loudspeaker system having no passive radiators at all. FIG. 10 depicts the frequency in Hz on the abscissa and the ordinate is shown between 60 and 100. The curve of frequency response of the system including the new passive radiator assembly is denoted as C1. The curve of frequency response of the system without any passive radiator assembly is denoted as C2. In a frequency range between roughly 30 Hz to 100 Hz the curve C1 is substantially above the curve C2 thus showing that the use of the new passive radiator assembly improves greatly the frequency performance of the loudspeaker system The new loudspeaker system according to at least one embodiment of the present invention may be easier to assemble due to having a new integral passive radiator assembly. The system may enable a new speaker structural design in which the passive radiators are not exposed to users. The system may further enable a more compact speaker design since the new structure is able to be inserted inside the speaker enclosure in a different way from conventional one.

What is claimed is:

1. A passive radiator assembly for a loudspeaker system comprising:

a pair of passive radiators including a first passive radiator and a second passive radiator; and a frame having a first opening, a second opening and a third opening, wherein the first opening and the second opening are located on parallel sides of the frame, respectively, wherein the first passive radiator and the second passive radiator are mounted into the first opening and the second opening of the parallel sides of the frame, respectively, so as to oppose each other at a predetermined distance, wherein the first passive radiator has a first maximum excitation amplitude and the second passive radiator has a second maximum excitation amplitude, and wherein the predetermined distance between the mounted first passive radiator and the mounted second passive radiator is larger than a sum of the first maximum excitation amplitude and the second maximum excitation amplitude.

2. The passive radiator assembly of claim 1, wherein an opening area of the third opening is equal to or larger than ⅛ of a sum of a total area of each of the first passive radiator and the second passive radiator.

3. The passive radiator assembly of claim 1, wherein the first passive radiator and the second passive radiator are similar.

4. The passive radiator assembly of claim 1, wherein the frame has a first side opposite to the third opening; wherein the first side together with the first passive radiator and the second passive radiator mounted into the first opening and the second opening of the parallel sides form three sides of an enclosure.

5. The passive radiator assembly of claim 4, wherein the three sides of the enclosure are sealed.

6. The passive radiator assembly of claim 1, wherein the frame is made of at least one of metal, ceramics, plastics, or wood.

7. The passive radiator assembly of claim 1, wherein each of the first passive radiator and the second passive radiator comprise a spider and a center panel.

8. The passive radiator assembly of claim 7, wherein the spider includes rubber and wherein the center panel includes metal.

9. A loudspeaker system comprising:

the passive radiator assembly according to claim 1;

a speaker box; and a speaker driver; the speaker box including a slot into which the passive radiator assembly is mounted.

10. The loudspeaker system of claim 9, wherein the speaker driver is mounted into a front side of the speaker box, and wherein the passive radiator assembly is mounted into the slot such that the third opening of the passive radiator assembly is located at the front side of the speaker box.

11. The loudspeaker system of claim 9, wherein the third opening of the passive radiator assembly is exposed to external air when mounted into the slot.

12. The loudspeaker system of claim 9, wherein the speaker box, the speaker driver, and the passive radiator assembly mounted into the slot form a sealed enclosure.

13. The loudspeaker system of claim 12, wherein the passive radiator assembly is mounted into the slot with at least one glue or screws.

14. A method of retrofitting the loudspeaker system, the loudspeaker system including a speaker driver, a speaker box comprising a slot into which a passive radiator assembly is mountable, the method comprising:

providing the loudspeaker system; and mounting the passive radiator assembly according to claim 1 into a slot such that an opening of the passive radiator assembly is exposed to external air when mounted into the slot.

15. A passive radiator assembly for a loudspeaker system comprising:

a first passive radiator;

a second passive radiator; and a frame having a first opening, a second opening and a third opening, wherein the first opening and the second opening are located on parallel sides of the frame, respectively, wherein the first passive radiator and the second passive radiator are mounted into the first opening and the second opening of the parallel sides of the frame, respectively, and wherein the first passive radiator and the second passive radiator oppose each other at a predetermined distance when the first passive radiator is mounted into the first opening and when the second passive radiator is mounted into the second opening, wherein the first passive radiator has a first maximum excitation amplitude and the second passive radiator has a second maximum excitation amplitude, and wherein the predetermined distance between the mounted first passive radiator and the mounted second passive radiator is larger than a sum of the first maximum excitation amplitude and the second maximum excitation amplitude.

16. The passive radiator assembly of claim 15, wherein an opening area of the third opening is equal to or larger than ⅛ of a sum of a total area of each of the first passive radiator and the second passive radiator.

17. The passive radiator assembly of claim 15, wherein the first passive radiator and the second passive radiator are similar.

18. The passive radiator assembly of claim 15, wherein the frame includes a first side opposite to the third opening; and wherein the first side together with the first passive radiator and the second passive radiator mounted into the first opening and the second opening of the parallel sides form three sides of an enclosure.

* * * * *